US009419352B2

(12) United States Patent
Hyder

(10) Patent No.: US 9,419,352 B2
(45) Date of Patent: Aug. 16, 2016

(54) TERMINAL BLOCK WITH GROUND STRAP, SPRING FORCE TERMINALS, AND SCREW LUG TERMINAL

(71) Applicant: GE LIGHTING SOLUTIONS, LLC, East Cleveland, OH (US)

(72) Inventor: LaShannon S. Hyder, Taylors, SC (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 14/715,671

(22) Filed: May 19, 2015

(65) Prior Publication Data

US 2016/0028170 A1 Jan. 28, 2016

Related U.S. Application Data

(60) Provisional application No. 62/028,061, filed on Jul. 23, 2014.

(51) Int. Cl.

| | |
|---|---|
| ***H01R 9/24*** | (2006.01) |
| ***H01R 4/36*** | (2006.01) |
| ***H01R 4/48*** | (2006.01) |
| ***H01R 13/58*** | (2006.01) |

(52) U.S. Cl.

CPC ..... *H01R 9/2416* (2013.01); *H01R 4/36* (2013.01); *H01R 4/4827* (2013.01); *H01R 4/4845* (2013.01); *H01R 13/582* (2013.01)

(58) Field of Classification Search

USPC ..... 439/404, 449, 374, 714, 521, 713, 719, 439/469, 462; 174/99 R, 135

See application file for complete search history.

(56) References Cited

U.S. PATENT DOCUMENTS

| | | | | |
|---|---|---|---|---|
| 3,135,822 A | | 6/1964 | Baran | |
| 5,015,201 A | * | 5/1991 | Brezee | H01R 4/4827 439/441 |
| 5,192,234 A | * | 3/1993 | Heng | H01R 4/363 439/709 |
| 5,314,360 A | * | 5/1994 | Jaag | H01R 4/363 439/806 |
| 5,480,323 A | | 1/1996 | Mews | |

(Continued)

FOREIGN PATENT DOCUMENTS

| | | |
|---|---|---|
| DE | 2632063 A1 | 1/1978 |
| DE | 7801829 U1 | 6/1981 |

(Continued)

OTHER PUBLICATIONS

European Search Report and Opinion issued in connection with corresponding EP Application No. 15177610.1 on Nov. 26, 2015.

*Primary Examiner* — Alexander Gilman

(74) *Attorney, Agent, or Firm* — GE Global Patent Operation; Peter T. DiMauro

(57) ABSTRACT

A terminal block assembly includes a housing, a housing retention member coupled to the housing, a plurality of screw lug terminal assemblies disposed within the housing and a plurality of push-in terminal assemblies disposed within the housing. A push-in terminal of the plurality of push-in terminal assemblies includes a strain relief member and a retention spring assembly. The retention spring assembly includes a finger member and a conductor member. The conductor member electrically couples the finger member to a corresponding screw-lug terminal assembly. A bottom portion of the strain relief member engages the conductor member of the retention spring assembly to retain the retention spring assembly within the housing. A ground strap is disposed within the housing.

17 Claims, 17 Drawing Sheets

(56) References Cited

U.S. PATENT DOCUMENTS 5,595,505 A * 1/1997 Duke ..... H01R 4/34 439/630
5,741,073 A * 4/1998 Ribeiro ..... H01R 4/363 374/182
5,741,161 A * 4/1998 Cahaly ..... H01R 12/515 439/637
6,010,347 A * 1/2000 Lee ..... H01R 4/36 439/107
7,048,591 B1 * 5/2006 Chiang ..... H01R 4/363 439/709
7,097,502 B2 * 8/2006 Landis ..... H01R 4/36 439/595
7,101,231 B2 * 9/2006 Prokup ..... H01R 4/4809 439/709
7,115,001 B1 * 10/2006 Brockman ..... H01R 4/4827 439/441
7,347,739 B2 * 3/2008 Cox ..... H01R 4/38 439/709
7,544,103 B2 * 6/2009 Walter ..... H01R 4/4836 439/441
7,845,969 B2 * 12/2010 Stadler ..... H01R 9/2458 439/441
7,909,633 B1 * 3/2011 Miller ..... H01R 4/305 439/441
8,353,716 B2 1/2013 Keswani
8,485,841 B2 * 7/2013 Schrader ..... H01R 4/4827 439/441
8,517,758 B2 * 8/2013 Pizzi ..... H01R 9/2683 439/491
8,905,766 B2 * 12/2014 Her ..... H01R 4/64 439/95
9,004,956 B2 * 4/2015 Wu ..... H01R 4/34 439/709

FOREIGN PATENT DOCUMENTS

| | | | |
|---|---|---|---|
| DE | 19729014 | A1 | 1/1999 |
| DE | 19934550 | A1 | 2/2001 |
| DE | 20300266 | U1 | 5/2004 |
| EP | 1403969 | A1 | 3/2004 |
| JP | H0845572 | A | 2/1996 |
| WO | 2013168334 | A1 | 11/2013 |
| WO | 2013168340 | A1 | 11/2013 |

* cited by examiner

TERMINAL BLOCK WITH GROUND STRAP, SPRING FORCE TERMINALS, AND SCREW LUG TERMINAL

FIELD

The aspects of the present disclosure relate generally to terminal blocks for electrical power distribution. In particular, the aspects of the disclosed embodiments are directed to an improved terminal block for electrical power distribution to luminaires.

BACKGROUND

In the distribution of electric power, terminal blocks, also called distribution blocks are often employed. The applications for these terminal blocks can vary widely and include for example, luminaire test fixtures. A luminaire test fixture, which is generally used during a luminaire manufacturing process can include a source of electrical power, and a ballast. The terminal block is used to couple the electrical power to the ballast, or other driver for the luminaire.

Typically the terminal block includes a connection for a larger conductor cable or bus and a plurality of tap connections for smaller conductors. In a common application, the bare ends of the conductors are inserted in socket ports or holes in the distribution block. A clamp or binding screw is threaded into a hole perpendicular to the socket receiving the conductor to hold or secure the conductor in place, in an electrically conductive manner. In some cases push-on terminal flag type terminals or connectors can be used as the tap connections for the smaller conductors. The flag terminal end of the conductor is received on a flag terminal end disposed on the terminal block.

The use of the typical terminal block in the luminaire manufacturing process will generally require crimped connectors, additional leads, additional connectors, dedicated ground screws and additional ground eyelets. The power line leads providing the source of electrical power will be received in the socket ports and held in place when the screw is tightened down. The leads or conductors leading to the luminaire, referred to as "driver" leads will generally have the crimped terminal flag connectors that allow them to be connected to the terminal block. Very often, there will be multiple conductors per terminal flag connection.

It can be impractical during the manufacturing process to assemble crimp connectors to the driver leads, which requires additional leads to be manufactured with crimp terminals. When additional leads are required, it necessitates the need for additional connectors to connect driver/ballast leads. Also, a dedicated ground screw and additional round eyelet are required to ground the luminaire to the ground pole of the terminal block. It would be advantageous to provide a terminal block that eliminates the need for crimped connectors, additional leads and connectors, dedicated ground screws, and ground eyelets.

Accordingly, it would be desirable to provide a terminal block that addresses at least some of the problems identified above.

BRIEF DESCRIPTION OF THE DISCLOSED EMBODIMENTS

As described herein, the exemplary embodiments overcome one or more of the above or other disadvantages known in the art. One aspect of the exemplary embodiments relates to a terminal block assembly. In one embodiment, the terminal block assembly includes a housing, a housing retention member coupled to the housing, a plurality of screw lug terminal assemblies disposed within the housing, a plurality of push-in terminal assemblies disposed within the housing, wherein a push-in terminal of the plurality of push-in terminal assemblies includes a strain relief member, and a retention spring assembly comprising a finger member and a conductor member, the conductor member electrically coupling the finger member to a corresponding screw-lug terminal assembly, a bottom portion of the strain relief member engaging the conductor member of the retention spring assembly to retain the retention spring assembly within the housing, and a ground strap disposed within the housing and extending to the housing retention member, wherein the ground strap is electrically coupled to one screw lug terminal assembly of the plurality of screw lug terminal assemblies.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the present disclosure, and together with the general description given above and the detailed description given below, serve to explain the principles of the present disclosure. As shown throughout the drawings, like reference numerals designate like or corresponding parts.

DETAILED DESCRIPTION OF THE EXEMPLARY EMBODIMENTS OF THE DISCLOSURE

Figure 1:
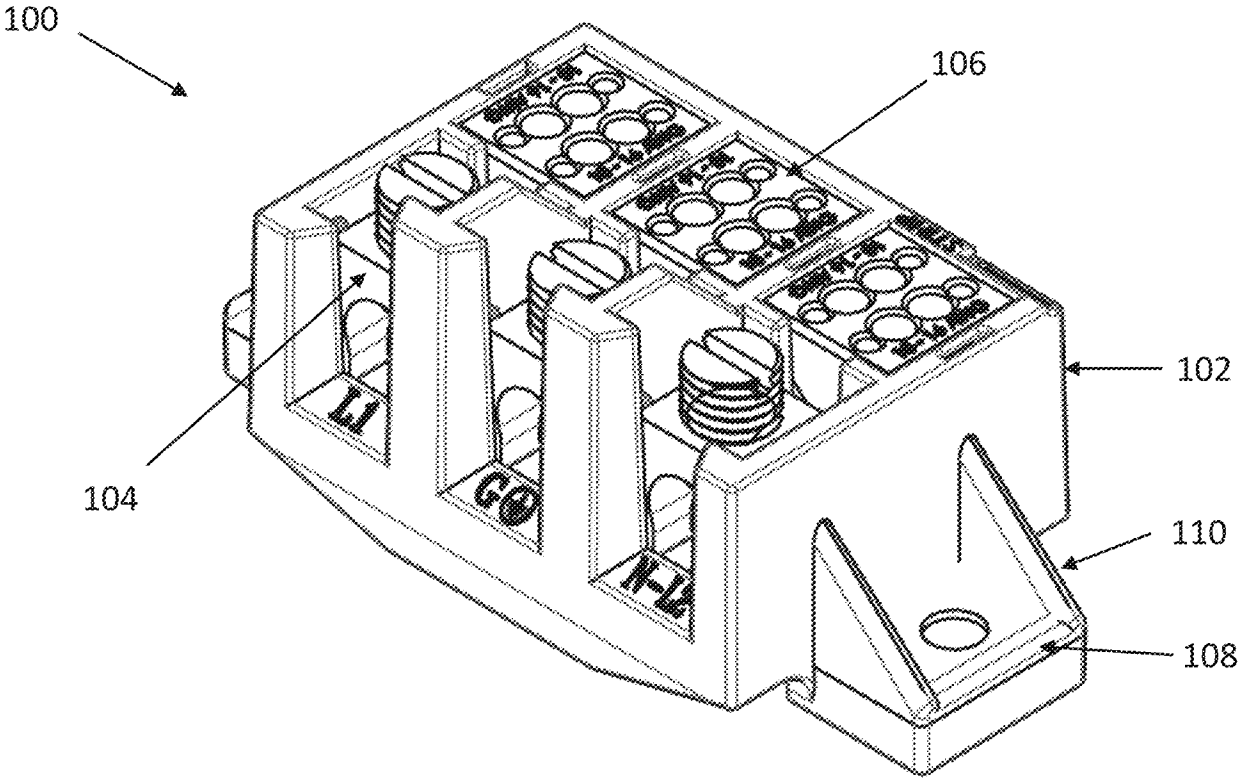
FIG. 1 is a perspective view of an exemplary terminal block assembly incorporating aspects of the disclosed embodiments.

FIG. 1 illustrates a perspective view of one embodiment of a terminal block assembly 100 incorporating aspects of the present disclosure. The terminal block assembly 100 of the disclosed embodiment improve manufacturing efficiencies during the luminaire manufacturing process. For example, the improved terminal block assembly 100 of the disclosed embodiments may eliminates or reduce the need for components such as crimped connectors, additional leads, additional connectors, dedicated ground screws, and additional ground eyelet. While the aspects of the disclosed embodiments are generally described herein with respect to a luminaire manufacturing processes, the aspects of the disclosed embodiments are not so limited. In alternate embodiments, the terminal block assembly 100 can be implemented in any suitable application where electrical power is distributed.

As shown in FIG. 1, in one embodiment, the terminal block assembly 100 includes a housing 102, one or more screw lug terminal assemblies 104, one or more push-in terminal assemblies 106 and an integrated grounding strap 108. In one embodiment, the housing 102 comprises a non-conductive, elastomeric material, as is generally understood. In the example of FIG. 1, the terminal block assembly 100 includes three screw lug terminal assemblies and three corresponding push-in terminal assemblies. In alternate embodiments, the terminal block assembly 100 can include any suitable number of screw lug terminal assemblies and corresponding push-in terminal assemblies, such as more or less than three.

Figure 2:
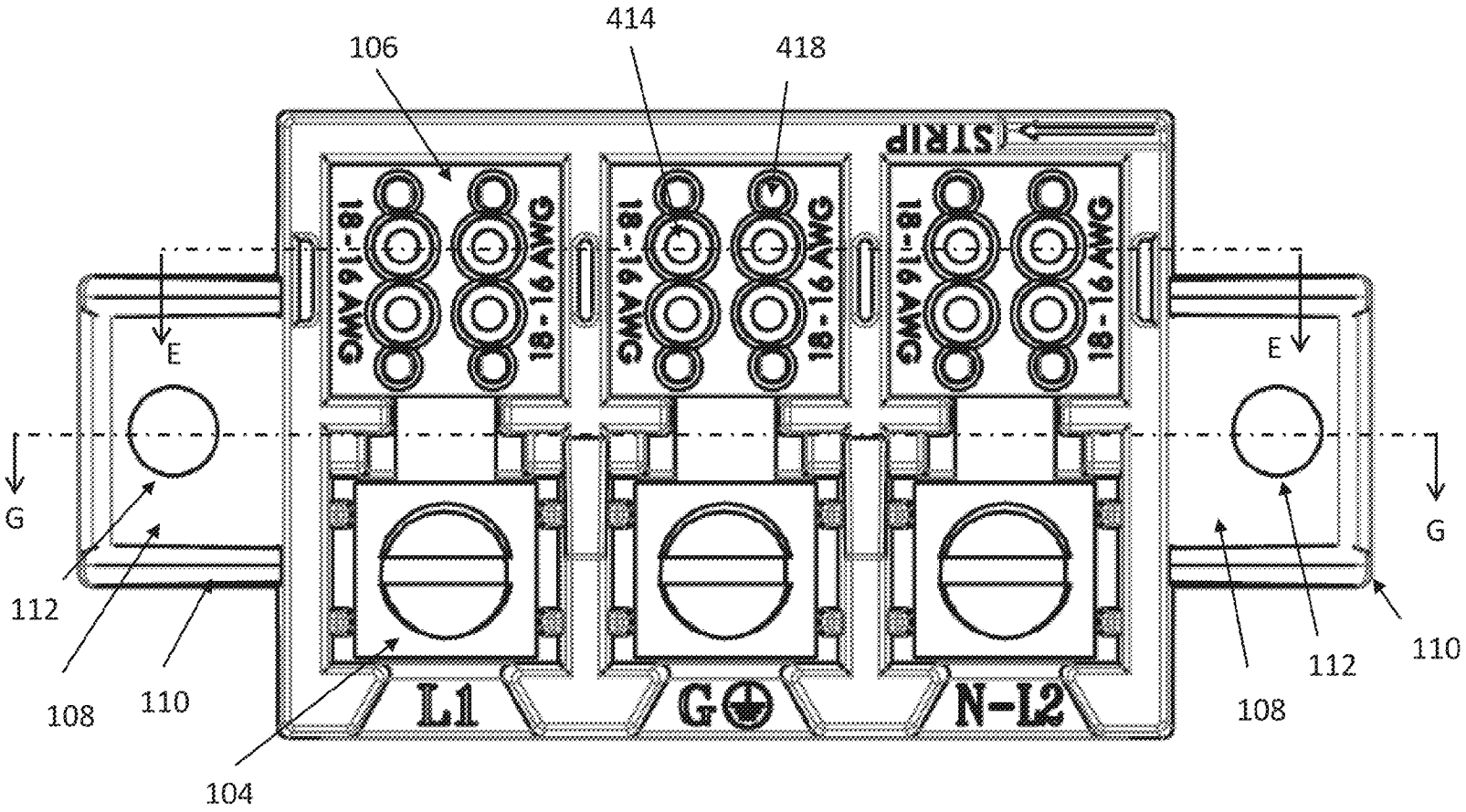
FIG. 2 is a top view of the terminal block of FIG. 1.
Figure 3:
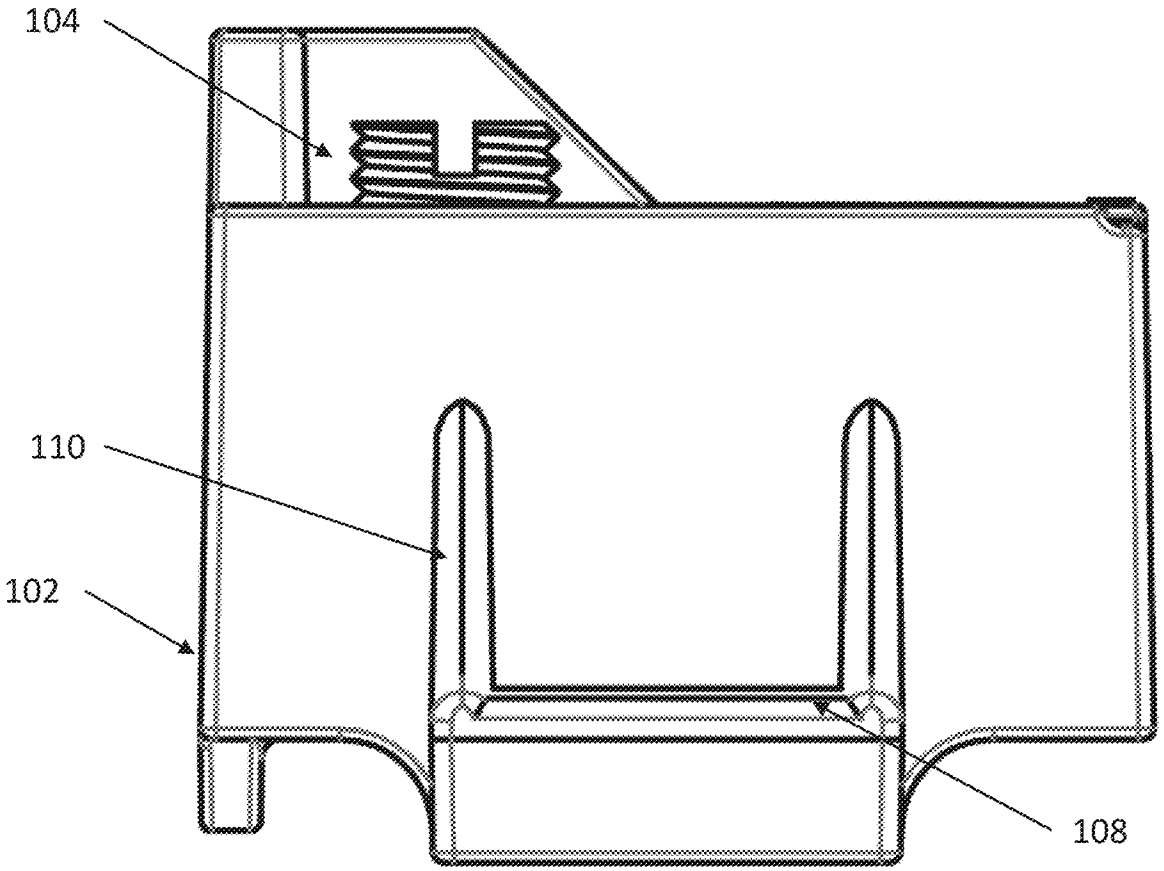
FIG. 3 is a side view of the terminal block of FIG. 1.

In one embodiment, the housing 102 includes one or more retaining members 110. Referring to FIGS. 1 and 2, there is a retaining member 110 on either side of the housing 102. The retaining member 110 is generally configured to secure the terminal block assembly 100 to a fixture (not shown). In alternate embodiments, any suitable number of retaining members can be implemented in any suitable locations to secure the terminal block assembly 100 to any suitable fixture.

Referring to FIG. 2, for example, the retaining member 110 includes an aperture 112 that allows a fastener (not shown) to be inserted to secure the housing 102 to a corresponding fixture (not shown). In one embodiment, the retaining member 110 comprises a bracket portion of the housing 102.

Figure 4:
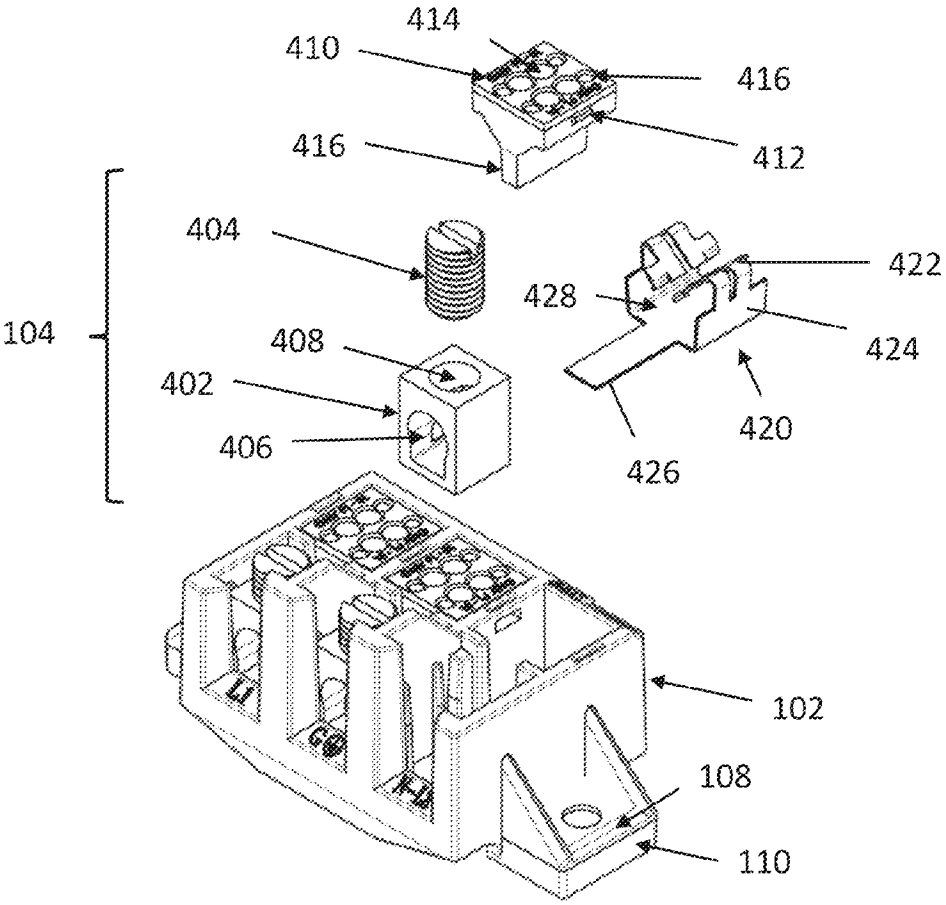
FIG. 4 is a partial assembly view of the terminal block of FIG. 1.

Referring also to FIG. 4, the screw lug terminal assembly 104 generally comprises a conductor receiving member 402 and a conductor retaining member 404. The screw lug terminal assembly 104 comprises a conductive material, such as tin plated aluminum for example. In alternate embodiments, the screw lug terminal 104 can comprise any suitable conductive material, other than including tin plated aluminum. In the example of FIG. 1, there are three screw lug terminal assemblies 104, one for each leg or phase of the power connection, such as L1, Ground and L2 or Neutral. In alternate embodiment, there can be any suitable number of screw lug terminals assemblies, such as two or four, for example.

Figure 5:
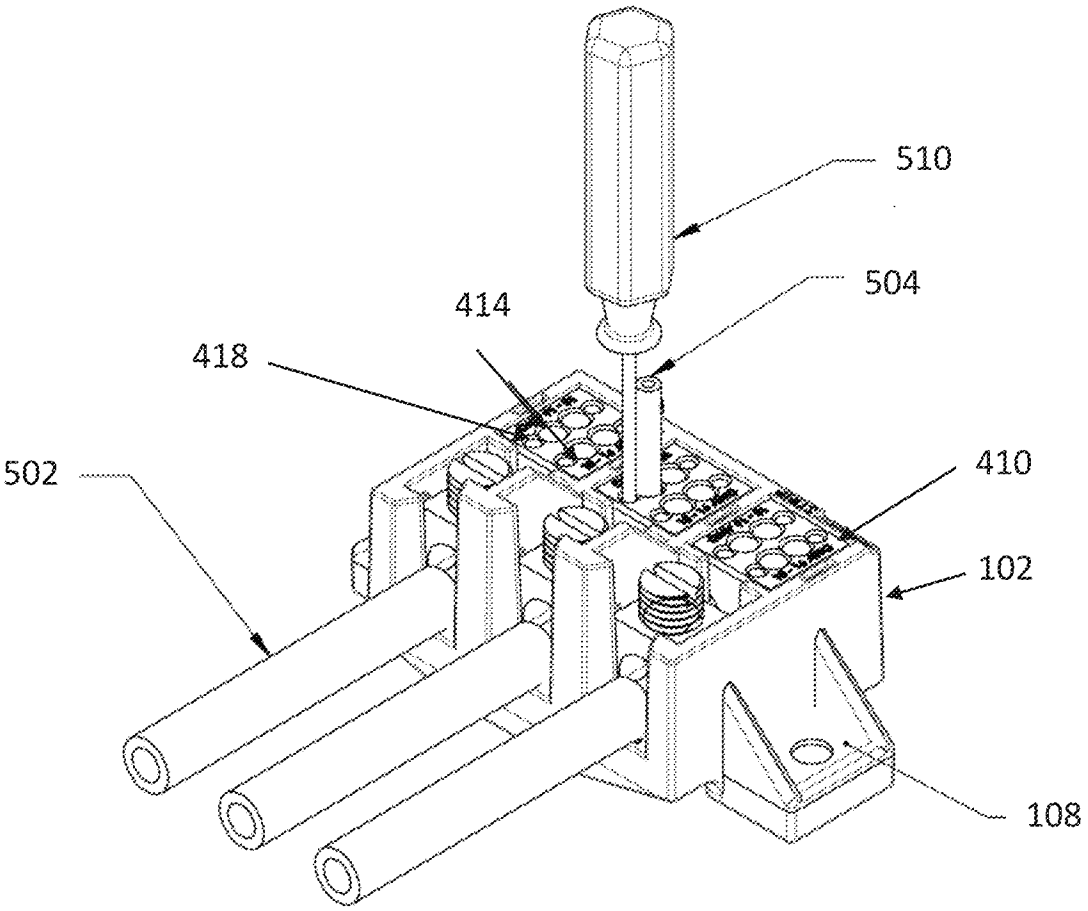
FIG. 5 illustrates the terminal block of FIG. 1 with leads and a lead removal tool.

In the example of FIG. 4, the conductor receiving member 402 comprises a conductive block, also referred to as a lug, with an opening or aperture 406. The aperture 406 is configured to receive a stripped end of a conductor, as is generally illustrated in FIG. 5. The conductor retaining member 404 in the example of FIG. 4 is a screw that engages a threaded portion 408 of the lug 402. Once the stripped end of the conductor is inserted into the aperture 406, the screw 404 is tightened to retain and electrically couple the conductor within the screw lug terminal assembly 104. An example of this is shown in FIG. 5.

As is illustrated in FIG. 5, the terminal block 100 is a junction between field leads 502 and manufacturing leads 504. In the examples describe herein, the field leads generally comprise electrical power leads. Typically, the field or power leads 502 will be, for example, #6 to #16 (Solid or Stranded) copper wire or #6 (Solid or Stranded) aluminium wire. In alternate embodiments, the screw lug terminal assemblies 104 can be configured to accept any suitably sized conductor leads, depending upon the specific application. Although a screw lug type of terminal assembly is illustrated as being used to couple the field leads 502 within housing 102 of the terminal block assembly 100, in alternate embodiments, the field leads 502 can be electrically coupled and secured in any suitable manner, other than including a screw lug terminal.

Figure 6:
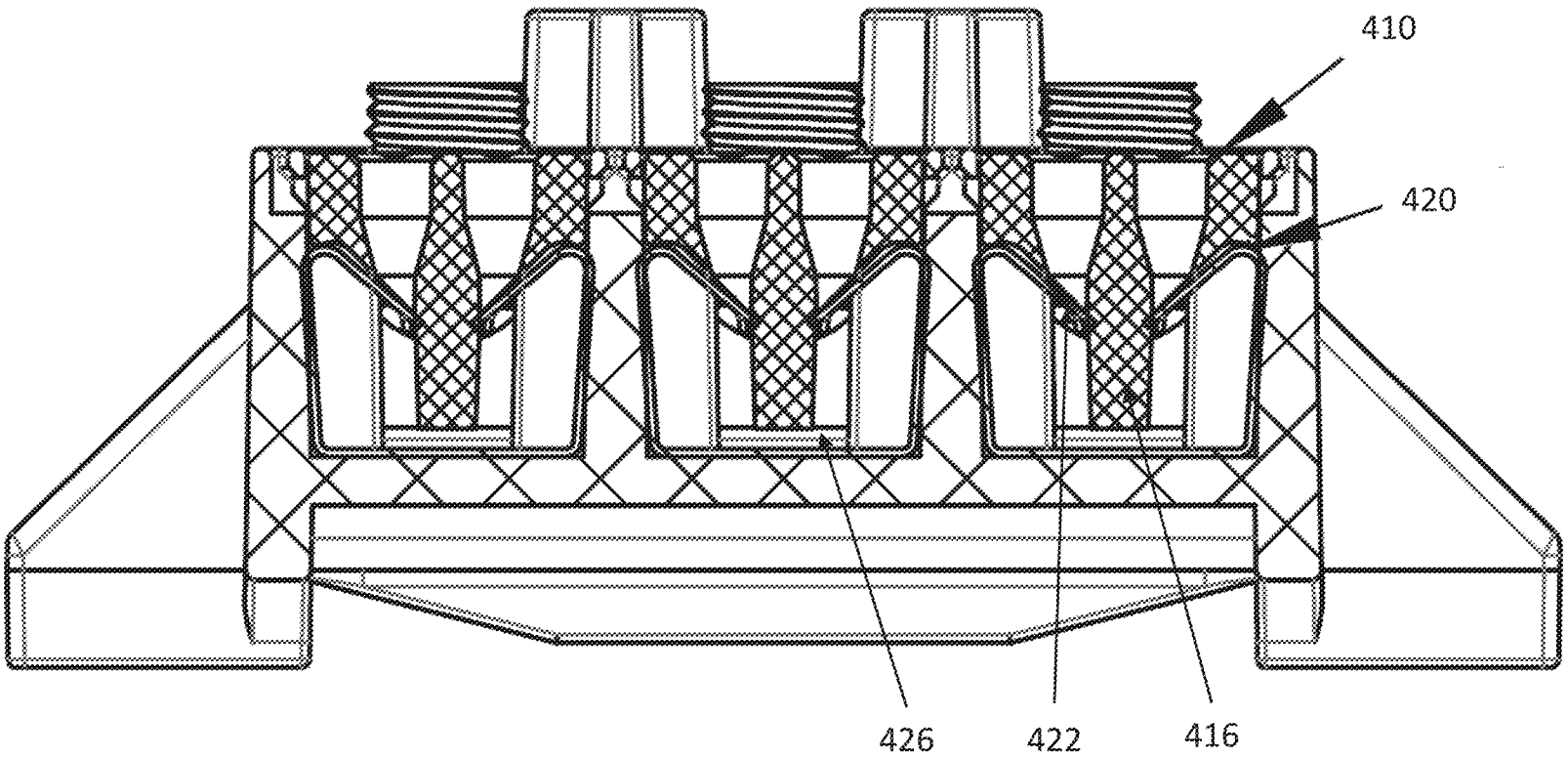
FIG. 6 is a cross-sectional view of the terminal block of FIG. 1 taken along the line E-E.
Figure 10:
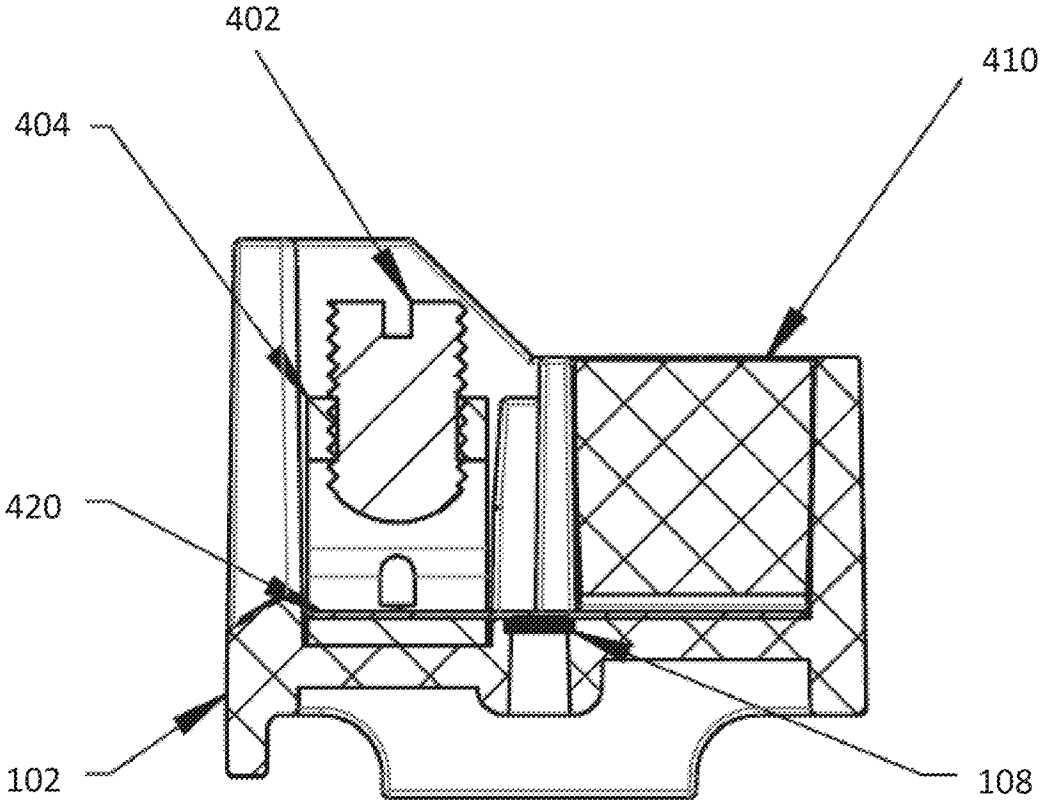
FIG. 10 is a cross-sectional side view of the terminal block of FIG. 1, taken along the line A-A of FIG. 9.

The terminal block assembly 100 is configured to permit the stripped ends of the manufacturing leads 504 to be pushed directly into the push-in terminal assembly 106 without the need of tools or crimped connectors. Referring to FIGS. 4, 6 and 10, in one embodiment, the push-in terminal assembly 106 generally comprises a strain relief/wire cap member 410 and a retention spring member 420. The push-in terminal assembly 106 is configured to allow the stripped end of a lead 504 to be inserted into one of the lead openings 414 in the strain relief member 410. The strain relief member 410 generally comprises a thermoplastic or other suitable non-conductive material.

In one embodiment, the strain relief member 410 is removably retained in a corresponding opening in the housing 102. As shown in FIG. 4, in one embodiment, the strain relief member 410 includes one or more tab members 412 on the side portions of the strain relief member 410 that are configured to allow the strain relief member 410 to "snap-in" the corresponding opening in the housing 102 without destroying or damaging a functionality of the strain relief member 410 and the terminal block assembly 100. Although tab members are illustrated in the example of FIG. 4, in alternate embodiments, the strain relief member 410 can be retained in the housing 102 in any suitable manner that allows the strain relief member 410 to be inserted without damage to either the strain relief member 410 or housing 102.

Figure 13:
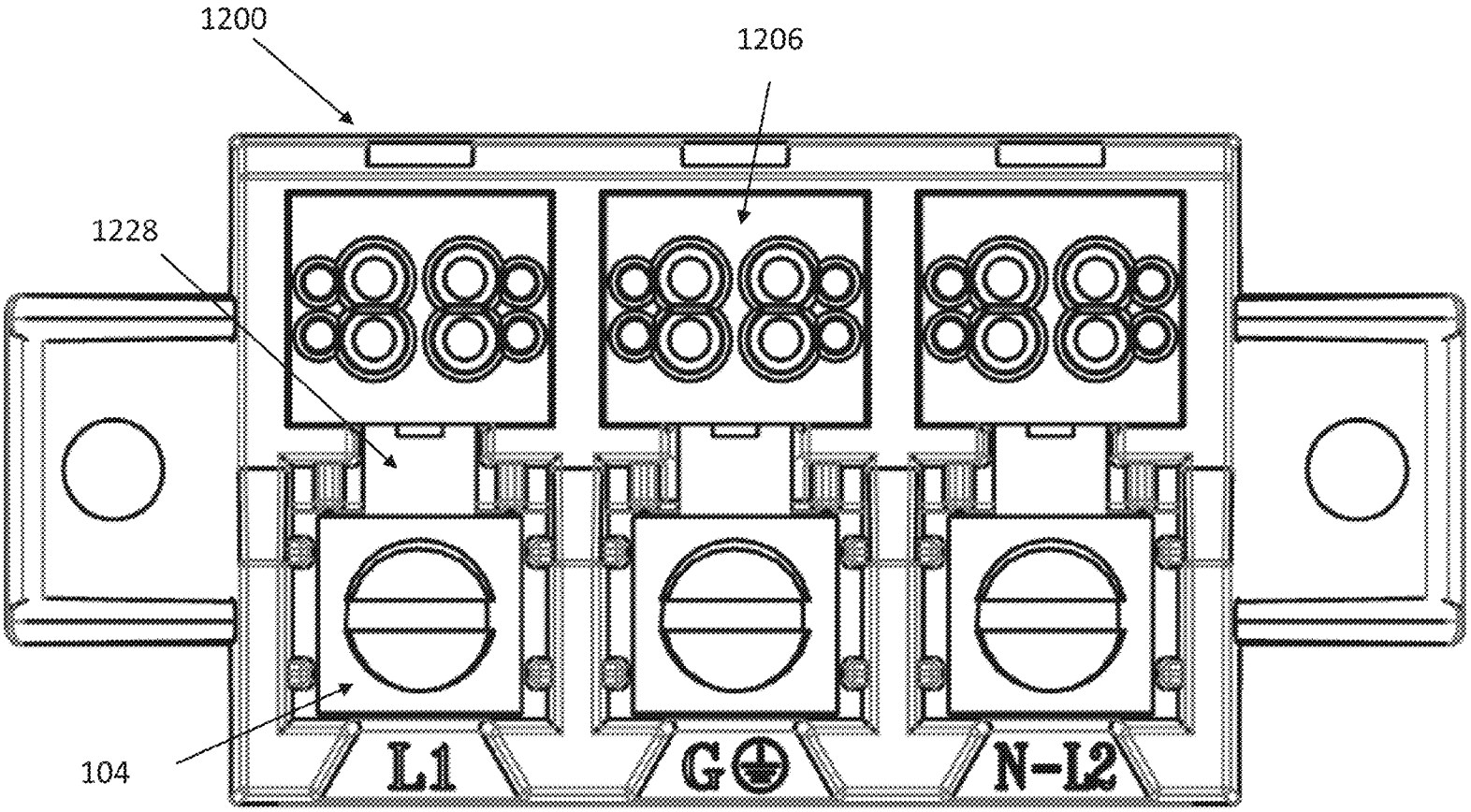
FIG. 13 is a top view of the terminal block of FIG. 12.

As shown in FIGS. 4 and 5, the top portion of the strain relief member 410 includes one or more lead openings 414. The lead openings 414 are configured to accommodate the manufacturing leads 504. In one embodiment, the one or more of the openings 414 have different sizes to accommodate different sized manufacturing leads 504. In the example of FIG. 4, the strain relief member 410 includes an arrangement of four lead openings 414. In alternate embodiments, the strain relief member 410 can include any suitable number of lead openings 414 in any suitable arrangement. FIG. 13 illustrates another exemplary arrangement of lead openings 414 incorporating aspects of the disclosed embodiments.

The retention spring member 420 generally comprises a conductive spring member. In one embodiment, the retention spring member 420 comprises a tin plated copper alloy. In alternate embodiments, the retention spring member 420 can comprise any suitable conductive material, such as a tin plated phosphor bronze.

In the example shown in FIG. 4, the retention spring member 420 comprises one or more finger members 422, a base portion 424 and a blade conductor portion or member 426. The one or more fingers members 422 are coupled to or integrated with the base portion 424. When a manufacturing lead 504 is inserted into a lead opening 414, the stripped end of the manufacturing lead will engage a respective finger member 422 to secure the lead 504 within the push-in terminal assembly 106 as well as establish an electrical connection between the manufacturing lead 504 and the finger member 422.

As is shown in FIG. 4, in one embodiment, there are finger members 422 on either side of the retention spring member 420 that define an opening or space 428 between the finger members 422 on each side. As will be described further below and is shown in FIG. 6, the opening 428 is suitably size to allow the blade portion 416 of the strain relief assembly 410 to be inserted therebetween.

The blade conductor member 426 of the retention spring member 420 is configured to engage a respective screw-lug terminal assembly 104 to electrically couple the retention spring member 420 to the respective screw-lug terminal assembly 104. The blade conductor 426 provides the electrical continuity between the leads 504 and the screw lug terminal 106. In the example shown in FIG. 4, the retention spring member 420 is a one piece assembly. Alternatively, such as in the embodiment shown in FIG. 14, the retention spring member 420 can comprise one or more parts that are electrically coupled together.

As is shown in FIG. 4, the blade portion 416 of the strain relief assembly 410 is narrower than the top portion of the strain relief member 410. In alternate embodiments, the blade portion 416 can be any suitable size and shape. The blade portion 416 is configured to extend downwards and be received within the opening 428 between the fingers 422 of the retention spring member 420. The bottom of the blade portion 416 will engage the blade conductor 426 to secure the retention spring member 420 in position within the housing 102.

The cross-sectional view of FIG. 6 shows the finger portions 422 of the retention spring member 420 pressing against the blade portion 416 of the strain relief assembly 410. When the stripped end of the manufacturing lead 504 is inserted into a corresponding lead opening 414, the stripped end of the lead 504 exerts pressure on the respective finger portion 422 to push the finger portions 422 away from the blade portion of the strain relief assembly 410. The stripped end of the lead 504 is retained between the retention spring member 420 and the blade portion 416 of the strain relief member 410. The retention spring member 420 is configured to maintain a constant pressure against the leads 504 and the blade portion 416.

The finger portion 422 of retention spring member 420 corresponding to an opening 414 is configured to press the stripped end of the lead 504 against the blade portion 416 to securely retain the lead 504. As is shown, there can be one or more lead openings 414 per strain relief member 410, which allows one or more manufacturing leads 504 to be electrically coupled, via the respective retention spring member 420 to a respective screw-lug terminal 104.

The terminal block assembly 100 of the disclosed embodiments is configured to allow the manufacturing leads 504 to be electrically coupled to the field leads 502 without the need for tools or crimped connectors. In one embodiment, the stripped end of a lead 504 is pushed through an opening 414 in the strain relief assembly 410. The stripped end of the lead 504 will depress, push aside or otherwise move, the finger member 422 of the retention spring assembly 420. In alternate embodiments, levers or push buttons can be used to depress the fingers member 422 before inserting the leads 504, and then released to retain the leads 504 as described herein.

The movement of the finger member 422 will allow the stripped end of the lead 504 to slide between the blade portion 416 and finger member 422 of the retention spring assembly 420. The flexible or spring like nature of the finger member 422 of the retention spring assembly 420 will allow the finger member 422 to maintain a substantially constant pressure against the stripped end of the lead 504. Thus, the retention spring assembly 420 will be electrically coupled to the lead 504.

The blade conductor 426 of the retention spring assembly 420 provides the electrical continuity between the leads 504 and the lug terminal 104. When a field lead 502 is electrically coupled to the screw lug terminal 104, the field lead 502 will be electrically coupled to the corresponding manufacturing lead 504. As was noted, there can be one or more leads 504 per push-in terminal 106, which are then electrically connected to the corresponding screw-lug terminal 104.

Figure 7:
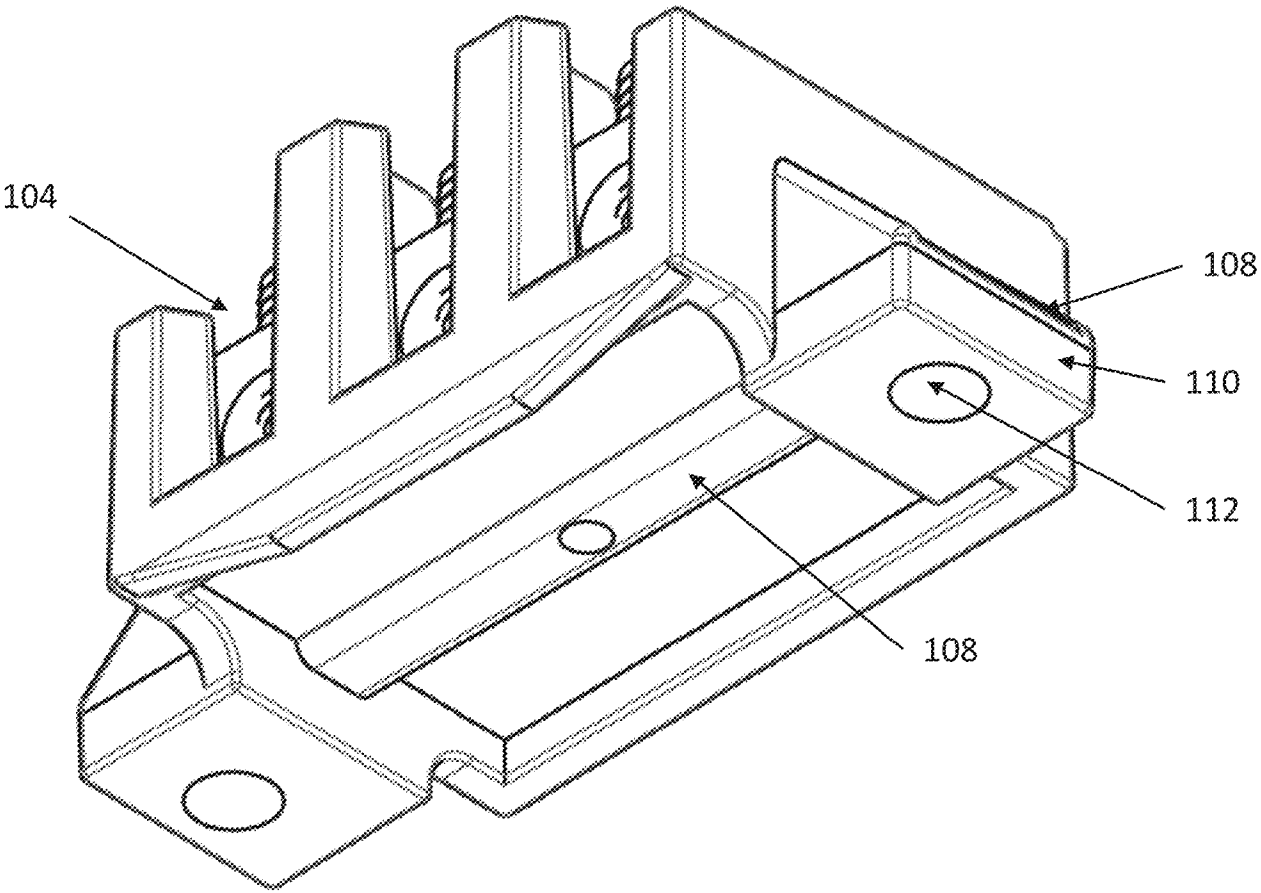
FIG. 7 is a bottom view of the terminal block of FIG. 1.
Figure 8:
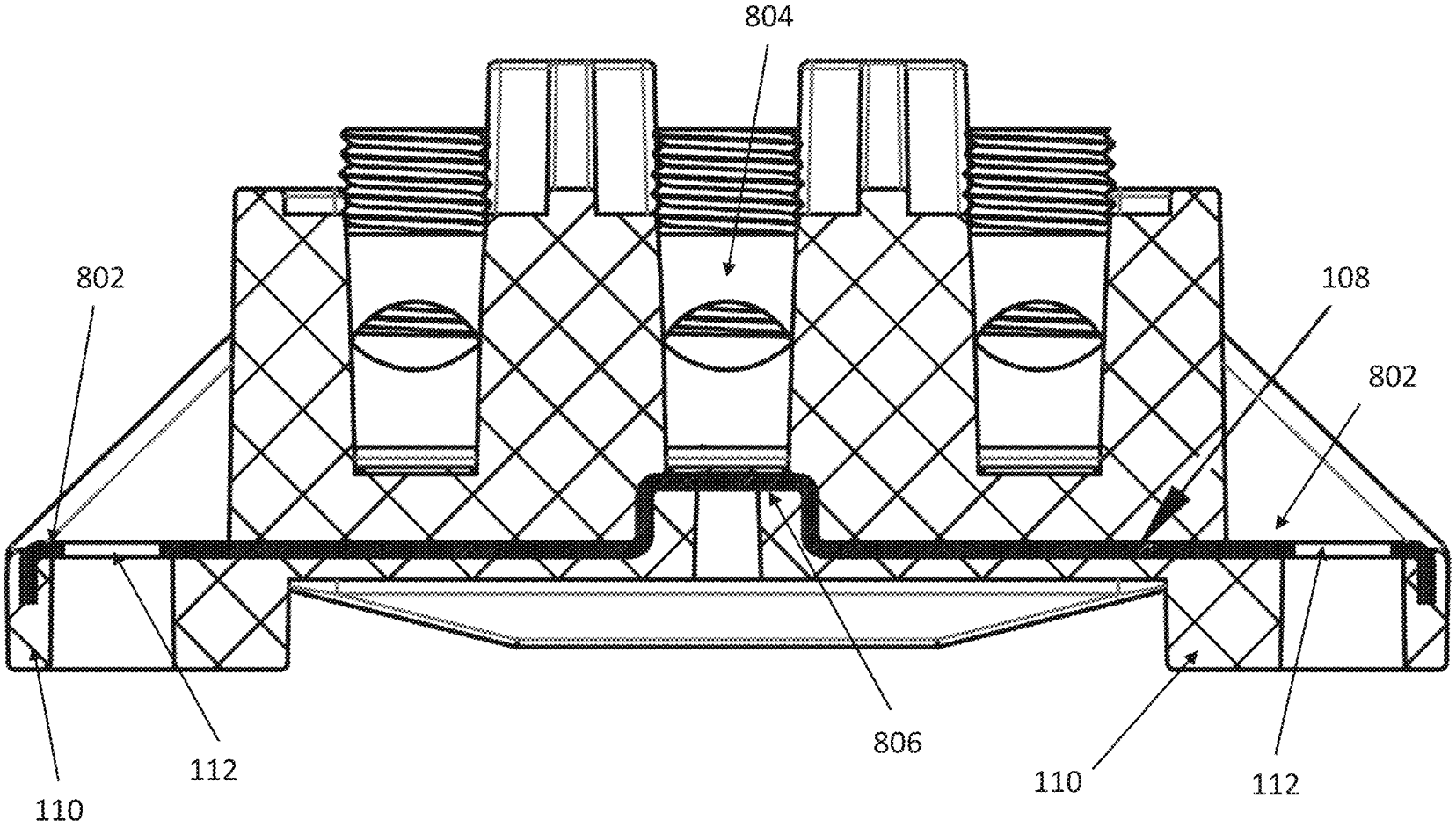
FIG. 8 is a cross-sectional view of the terminal block of FIG. 1 taken along the line G-G.
Figure 9:
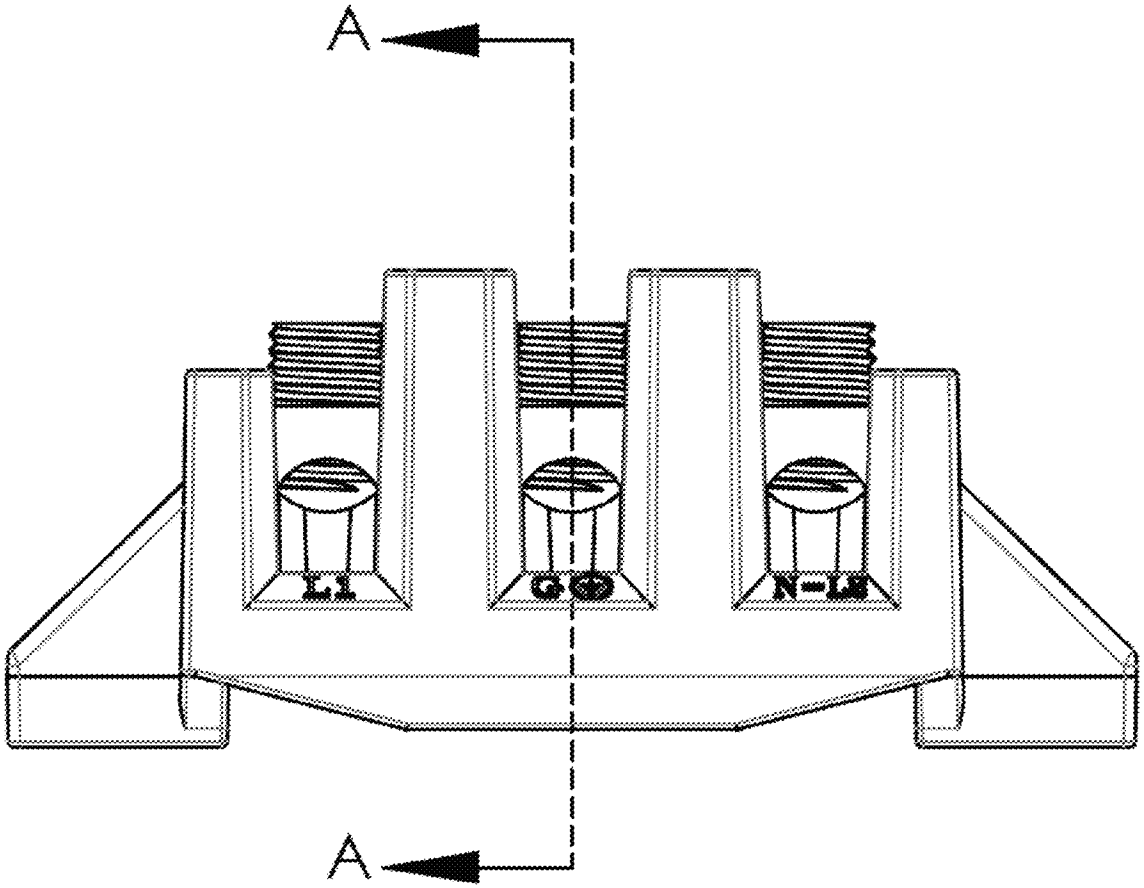
FIG. 9 is a front view of the terminal block of FIG. 1.

Referring to FIGS. 7 and 8, for example, in one embodiment, the terminal block assembly 100 includes an integrated ground strap 108. The ground strap 108 comprises a conductive member such as a tin plated copper alloy. In alternate embodiments, the ground strap 108 can comprises any suitable conductive material, such as a tin plated brass. The ground strap 108 is configured to provide an electrical ground path for the device, such as a luminaire, without the need for grounding straps.

As is shown in the cross-sectional views of FIG. 8, the ground strap 108 is over-molded in the housing 102. When mounting the terminal block assembly 100 to the luminaire, or other device, an electrical ground path is established, without then need for additional conductors. For example, the ground strap 108 provides a ground path is in lieu of having to connect a green jumper ground lead from the ground terminal of the terminal block to the luminaire housing.

As is shown in FIG. 8, the ground strap 108 extends through the body of the housing 102. A portion 802 of the ground strap 108 is disposed within the retaining member portion 110 of the terminal block assembly 100. In one embodiment, the portion 802 of the ground strap 108 circumscribes the aperture 112. When a conductive screw is inserted into the aperture 112 of the retaining member 110, the screw makes electrical contact with the portion 802 of the ground strap 108. The screw can be coupled to the electrical ground path of the luminaire to electrically couple the ground strap 108 to the electrical ground path.

As is shown in FIG. 8, the ground strap 108 extends through the body of the housing 102, from one retaining member 110 to the other retaining member 110. The grounds strap 108 is electrically coupled to the ground screw lug terminal 804. In the example of FIG. 8, the ground screw lug terminal 804 is the center screw lug terminal 104. In alternate embodiments, the ground screw lug terminal 804 can comprise any one of the screw lug terminal assemblies 104, other than including the center terminal.

The ground strap 108 in FIG. 8 includes a bent portion or connection point 806 that electrically engages the ground screw lug terminal 804. The ground strap 108 is spaced apart from the other screw lug terminal assemblies 104 in a manner that prevents an electrical connection from being established. Thus, the ground strap 108 is configured to maintain electrical continuity only with the ground terminal of the terminal block assembly 100, which in this example, is the center terminal 804 and is electrically isolated from the other screw lug assemblies 104.

As noted above, in one embodiment, the stripped ends of the leads 504 can be inserted or pushed directly into the push-in terminals 106 without the need of tools or crimped connectors. As is illustrated in FIG. 5, a manufacturing lead release tool 510 can be used to depress the retention spring assembly 420 to release pressure on the manufacturing leads 504 and permit removal of the leads 504 from the push-in terminal assembly 106. The manufacturing lead release tool 510 is inserted into a lead release opening 418. The lead release tool 510 exerts pressure on the respective finger member 422 of retention spring assembly 420 which allows the lead 504 to be removed.

Figure 11:
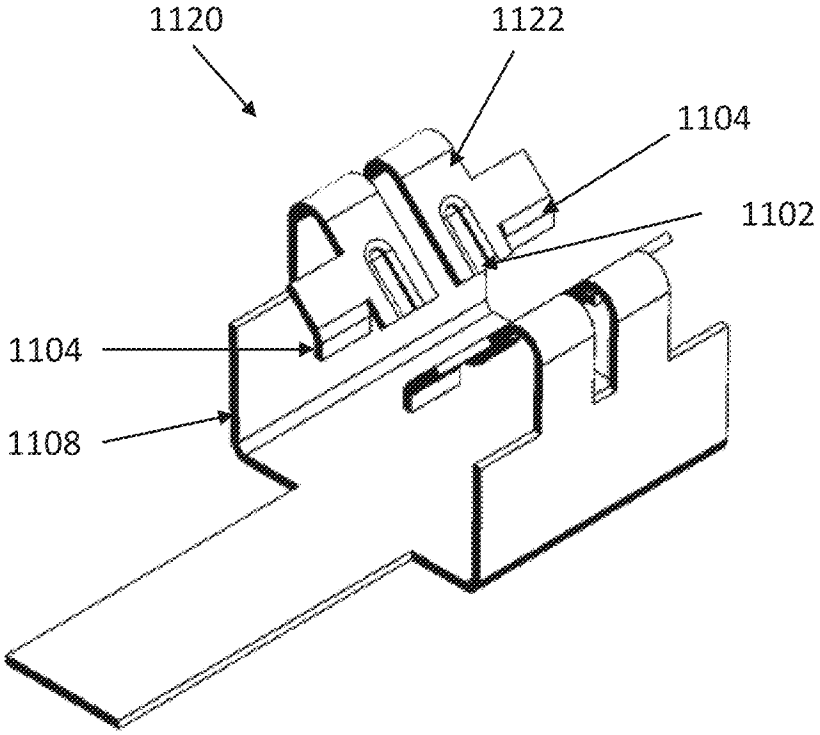
FIG. 11 illustrates an exemplary spring retention member incorporating aspects of the disclosed embodiments.

FIG. 11 illustrates one embodiment of a retention spring assembly 1120. The retention spring assembly 1120 in this example is similar to the spring retention spring assembly 420 shown in FIG. 4. In this example, the finger member 1122 includes a retaining portion 1102 and a bent or angled portion 1104. The retaining portion 1102 of the finger member 1122 will align with a respective lead opening 414 of the retention spring assembly 420. The bent portion 1104 will generally align with a respective lead release opening 418. In one embodiment, the bent portion 1104 is substantially parallel to the wall portion 1108 of the retention spring assembly 1120.

In this example, the stripped end of the leads 504, as was described above, will be retained between the blade portion 416 of the strain relief assembly 410 and the retaining portion 1102 of the finger member 1122. The bent portion 1104 will provide a space between the finger member 1122 and the blade portion 416 of the strain relief assembly 410 when the finger member 1122 is pressed against the strain relief assembly 410.

When the lead release tool 510 is inserted into the lead release opening 418, the lead release tool 510 will engage the bent portion 1104 of the finger member 1122 and press the finger member 1122 away from the blade portion 416 of the strain relief assembly 410. When the lead release tool 510 is removed from the lead release opening 418, the space between the bent portion 1104 and the blade portion 416 will allow the tool 510 to be removed without catching on or otherwise engaging the retaining spring assembly 420.

Figure 12:
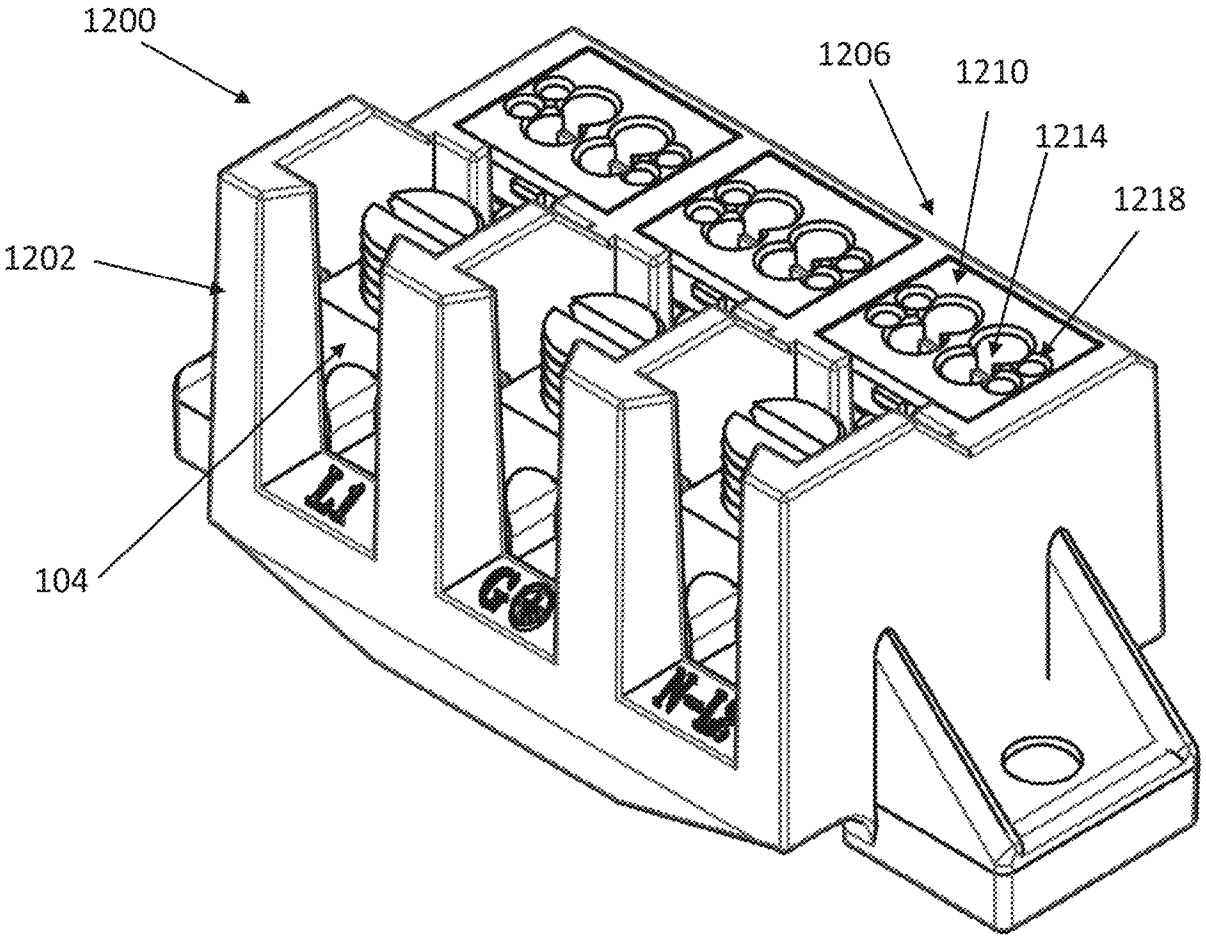
FIG. 12 is a perspective view of an exemplary terminal block assembly incorporating aspects of the disclosed embodiments.

FIG. 12 illustrates an alternative embodiment of a terminal block assembly 1200 incorporating aspects of the present disclosure. In this example, the strain relief assembly or cap 1210 of the push-in terminal assembly 1206 is rotated approximately 90 degrees within the housing 1202 relative to the orientation of the strain relief cap 410 of FIG. 1. Thus, the alignment of the lead openings 1214 and lead release openings 1218 in each of the push-in terminal assemblies 1206 are arranged in an end to end configuration rather than the front to back configuration of the strain relief assemblies 410 shown in FIG. 1.

Figure 14:
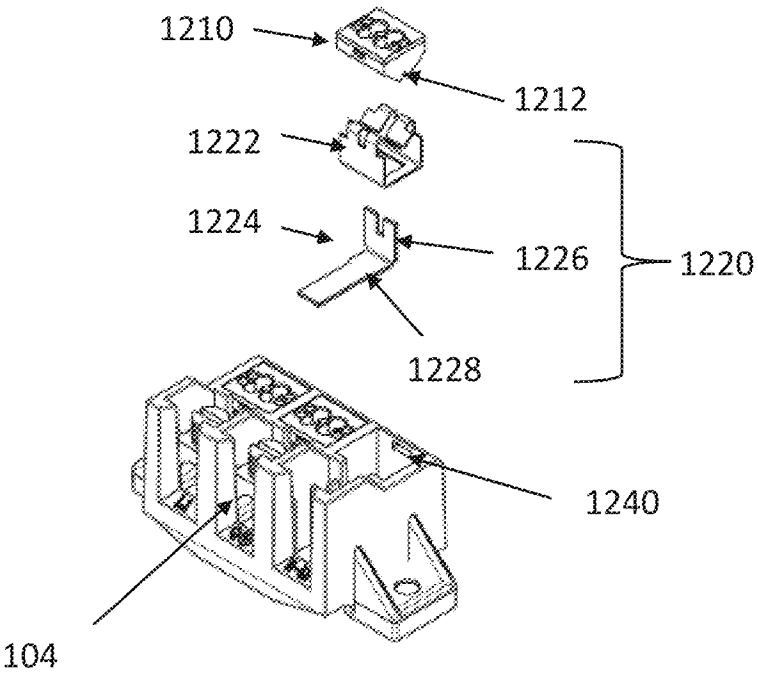
FIG. 14 is a partial assembly view of the terminal block of FIG. 12.
Figure 15:
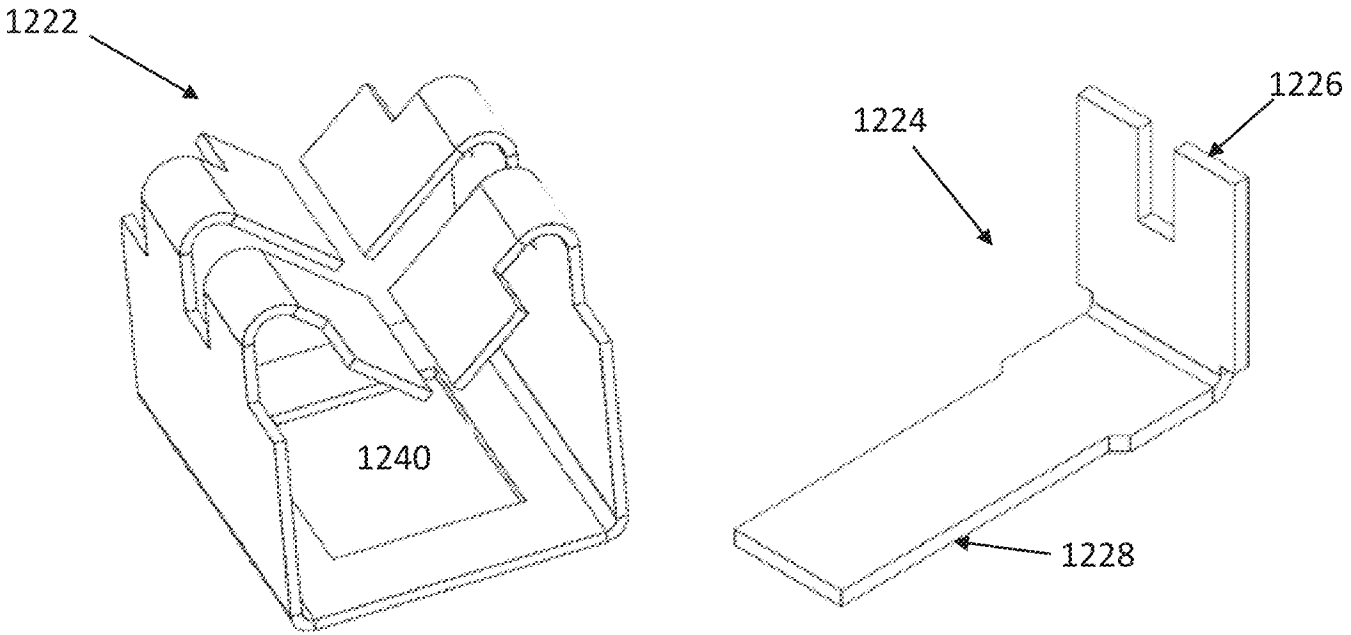
FIG. 15 illustrates an exemplary retention spring assembly incorporating aspects of the disclosed embodiments.
Figure 16:
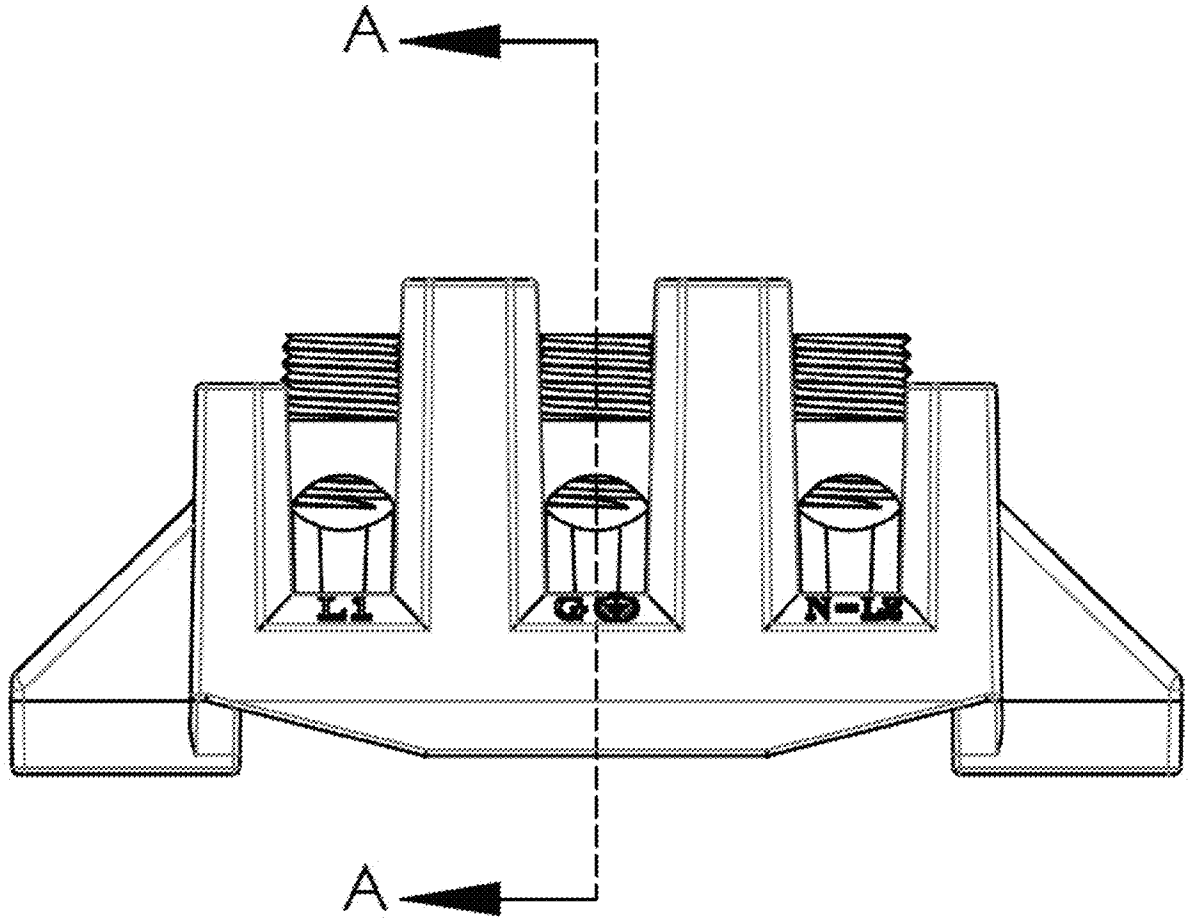
FIG. 16 is a front view of the terminal block of FIG. 12.

FIGS. 14-15 illustrate a component view of the strain relief cap 1210 and the retention spring assembly 1220 for the push-in terminal assembly 1206 of FIG. 12. In this example, the retention spring assembly 1220 comprises a two-piece assembly. As is shown in FIGS. 14 and 15, the retention spring assembly 1220 includes a finger member 1222 and a conductor member 1224. The conductor member 1224 is configured to extend upward through the opening 1230 in the finger member 1222 when assembled.

Figure 17:
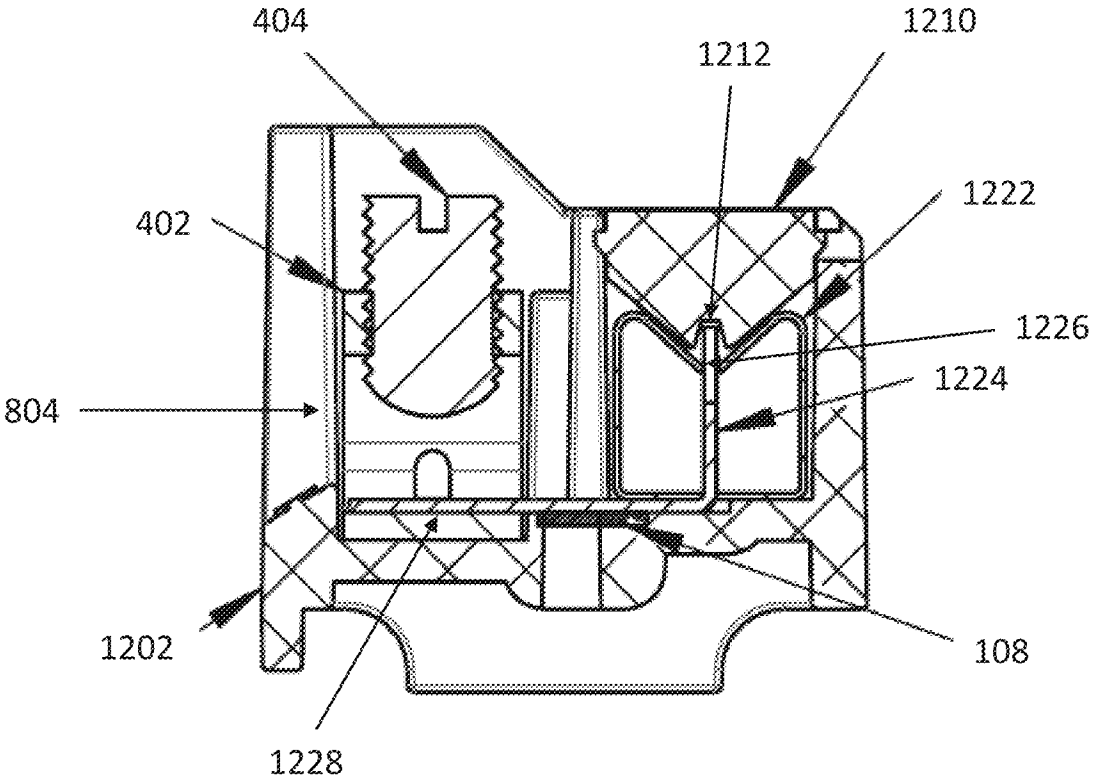
FIG. 17 is a side cross-sectional view of the terminal block of FIG. 12 taken along the line A-A of FIG. 16.

Referring also to FIG. 17, the strain relief cap 1210 is configured to be disposed on top of the finger member 1222 and the conductor member 1224. A top leg 1226 of the conductor member 1224 is received in a channel 1212 of the strain relief cap 1210. The other leg 1228 of the conductor member 1224 is configured to engage a screw lug terminal 104, in a manner as is generally described above with reference to screw lug terminals 104. In this example, the leg 1228 is engaging the center ground terminal 804 and ground strap 108 as earlier described.

When the stripped end of a lead 504 is inserted into a lead hole 1214, in this embodiment, the lead 504 will depress the finger portion 1222 of the retention spring assembly 1220 and be compressed between the finger portion 1222 and the conductor portion 1224. The channel 1212 of the strain relief cap 1210 retains the conductor member 1224 in position within the opening 1240 for the strain relief cap 1210.

Although the example of FIGS. 4 and 14 illustrate the screw lug terminal assemblies and push-in terminal assemblies being inserted from the top of the terminal block housing, in one embodiment, the components could be inserted from the bottom of the terminal block housing. The bottom could then be capped, as opposed to inserting the components from the top and capping it from the top.

The aspects of the disclosed embodiments provide a terminal block assembly with screw lug terminals, push-in lead terminals and an integrated grounding strap. The terminal block of the disclosed embodiments permits stripped leads to be pushed directly into the push-in terminal without the need for tools or crimped connectors. As a result, the manufacturing process requires less labor and fewer components, resulting in overall lower total luminaire cost.

Thus, while there have been shown, described and pointed out, fundamental novel features of the invention as applied to the exemplary embodiments thereof, it will be understood that various omissions and substitutions and changes in the form and details of devices and methods illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A terminal block assembly, comprising:

a housing;

a housing retention member coupled to the housing;

a plurality of screw lug terminal assemblies disposed within the housing;

a plurality of push-in terminal assemblies disposed within the housing, wherein a push-in terminal of the plurality of push-in terminal assemblies comprises:

a strain relief member; and a retention spring assembly comprising a finger member and a conductor member, the conductor member electrically coupling the finger member to a corresponding screw-lug terminal assembly;

a bottom portion of the strain relief member engaging the conductor member of the retention spring assembly to retain the retention spring assembly within the housing, the bottom portion of the strain relief member comprising a blade member, the blade member being narrower than an upper portion of the strain relief member and the finger member of the retention spring assembly engages a side portion of the blade member; and a ground strap disposed within the housing and extending to the housing retention member, wherein the ground strap is electrically coupled to one screw lug terminal assembly of the plurality of screw lugterminal assemblies.

2. The terminal block assembly of claim 1, wherein the strain relief member includes a lead opening in an upper portion of the strain relief member, the lead opening configured to receive a conductive wire.

3. The terminal block assembly of claim 2, comprising a lead tool opening in the upper portion of the strain relief member, the lead tool opening being adjacent to the lead opening, the lead tool opening configured to receive an end of a lead release tool.

4. The terminal block assembly of claim 1, wherein the finger member comprises a first lead engaging portion and a second bent portion, the second bent portion extending at an angle relative to the first lead engaging portion towards a bottom portion of the housing.

5. The terminal block assembly of claim 1, wherein the conductor member of the retention spring assembly comprises a first portion and a second portion, the first portion extending through an opening in the finger member to engage a bottom of the strain relief member, the second portion extending away from the first portion to engage the corresponding screw lug terminal assembly.

6. The terminal block assembly of claim 5, wherein the finger member presses against the first portion of the conductor member.

7. The terminal block assembly of claim 1, wherein the ground strap comprises a first connection portion and a second connection portion, the first connection portion disposed within the housing and engaging the one of the screw lug terminal assemblies and the second connection portion disposed in the housing retention member and configured to engage a fastener inserted into an aperture of the housing retention member.

8. A terminal block assembly, comprising:

a housing;

one or more screw lug terminal assemblies disposed within the housing;

a push-in terminal assembly for each of the one or more screw lug terminal assemblies, each push-in terminal assembly disposed within the housing adjacent to a screw lug terminal assembly, the push-in terminal assembly electrically coupled to the screw lug terminal assembly, wherein the push-in terminal assembly comprises:

a strain relief member disposed in an upper portion of the housing, the strain relief member including one or more openings configured to receive a conductive lead;

a retention spring member disposed in a lower portion of the housing under the strain relief member, the retention spring member comprising a finger portion and an arm portion, the finger portion aligned below a corresponding opening of the one or more openings in the strain relief member, the arm portion electrically coupled to the finger portion and the screw lug terminal assembly, the finger portion of the retention spring member comprising an opening, a first end of the arm portion extending through the opening and engaging a bottom portion of the strain relief member, a second end of the arm portion electrically coupled to the screw lug terminal assembly.

9. The terminal block assembly of claim 8, comprising a ground strap member disposed within a body portion of the housing, the ground strap member electrically coupled to one of the one or more screw lug terminal assemblies and a bracket that couples the housing to a fixture.

10. The terminal block assembly of claim 9, wherein the ground strap is molded within the body portion of the housing.

11. The terminal block assembly of claim 8, wherein the finger portion of the retention member is electrically coupled to the first of the arm portion.

12. The terminal block assembly of claim 8, wherein a bottom portion of the strain relief engages the arm portion of the retention spring member to secure the retention spring member within the housing.

13. The terminal block assembly of claim 12, the bottom portion of the strain relief member includes a channel portion, one end of the arm portion of the retention spring assembly engaging the channel portion to secure the retention spring assembly within the housing.

14. The terminal block assembly of claim 12, the bottom portion of the strain relief member comprising a projecting member, a bottom of the projecting member engaging the arm portion of the retention spring member and a side of the projecting member engaging the finger member.

15. The terminal block assembly of claim 8, wherein the finger portion comprise a first member and a second member, the second member being disposed at a downward angle relative to the first member.

16. The terminal block assembly of claim 15, wherein the finger portion of the retention spring member engages a side portion of the strain relief member, and the downward angle of the second member defines an opening between the second member of the finger portion of the retention spring member and the strain relief member.

17. The terminal block assembly of claim 8, wherein the finger member comprises a flexible conductive member.

* * * * *